US007913635B2

(12) United States Patent
Pusterla

(10) Patent No.: US 7,913,635 B2
(45) Date of Patent: Mar. 29, 2011

(54) SURFACE SKIMMING WATERCRAFT

(76) Inventor: Anthony Francis Pusterla, Bracken Ridge (AU)

( * ) Notice: Subject to any disclaimer, the term of this patent is extended or adjusted under 35 U.S.C. 154(b) by 0 days.

(21) Appl. No.: 12/370,121

(22) Filed: Feb. 12, 2009

(65) Prior Publication Data

US 2009/0217857 A1 Sep. 3, 2009

(30) Foreign Application Priority Data

Feb. 13, 2008 (AU) ..... 2008900671

(51) Int. Cl.
*B63B 1/24* (2006.01)

(52) U.S. Cl. ..... 114/274; 114/280

(58) Field of Classification Search ..... 114/274, 114/279, 280, 281; 440/113
See application file for complete search history.

(56) References Cited

U.S. PATENT DOCUMENTS

| | | | | | |
|---|---|---|---|---|---|
| 1,738,410 | A | * | 12/1929 | Weir | 114/271 |
| 2,488,310 | A | * | 11/1949 | Mayer | 440/100 |
| 3,237,582 | A | * | 3/1966 | Sturgeon et al. | 114/271 |
| 3,996,872 | A | * | 12/1976 | Pinchot, III | 114/280 |
| 4,061,104 | A | * | 12/1977 | Pinchot, III | 114/281 |
| 5,638,766 | A | * | 6/1997 | Pusterla | 114/274 |

* cited by examiner

*Primary Examiner* — Lars A Olson
(74) *Attorney, Agent, or Firm* — Kilpatrick Townsend & Stockton LLP

(57) ABSTRACT

A water craft including a hull having a main longitudinal axis defining a direction of travel of the craft, a plurality of discs mounted at respective opposed sides of the main longitudinal axis to and below the hull and in combination having sufficient buoyancy to support the hull above the water, each disc comprising an essentially circular convex skimming surface adapted to skim upon the water as the craft moves at low speed, wherein the discs are mounted to the hull such that the skimming surface of each disc faces downwardly with respect to the longitudinal central axis of the hull, and adapted for movement between a low speed orientation in which the discs present a portion of the circular convex skimming surface to the water surface and a high speed orientation in which the discs present a portion of the edge of the disc to the water.

13 Claims, 13 Drawing Sheets

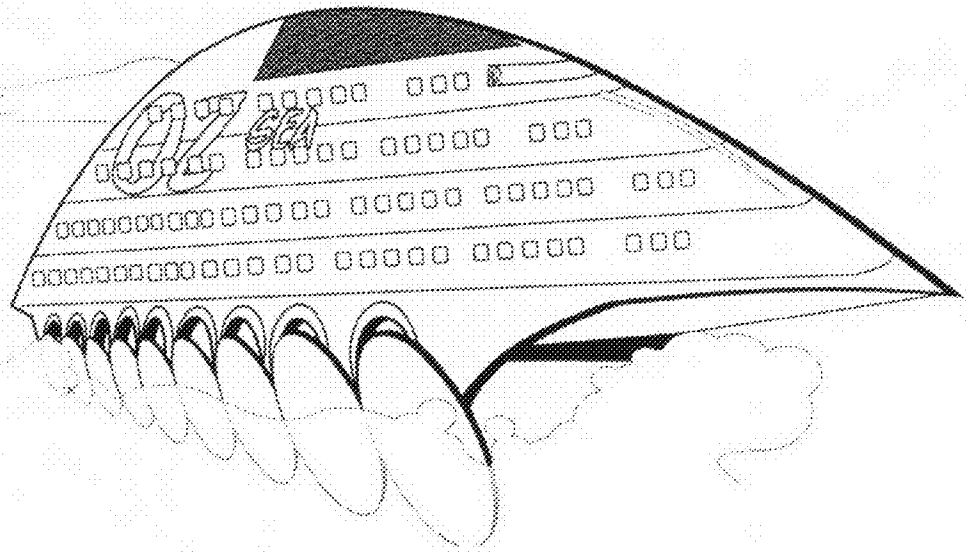
Figure 9
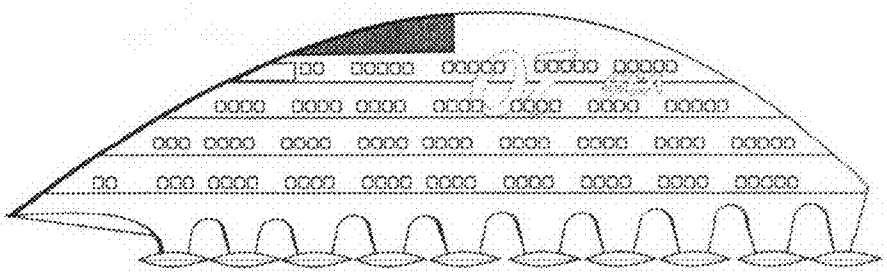

SURFACE SKIMMING WATERCRAFT

FIELD OF THE INVENTION

The present invention relates to a water craft and more particularly to a water craft adapted to travel across the surface of the water and minimise the immersion of the water craft.

BACKGROUND ART

Watercraft are known as are watercraft that have alternative support or buoyancy systems which rely on mechanisms other than the hull of the watercraft. It is generally assumed in marine architecture that the hull of a vessel is also the component of the vessel which rests on or partially submerged within the water.

Alternatives to this are vessels such as hydrofoils and the like which use shaped foils to create lift to remove the bulk of the watercraft hull from the water during travel.

Examples of attempts in the art to provide such a buoyancy system are contained in U.S. Pat. No. 3,237,582 which teaches a concave disc hydrofoil and U.S. Pat. No. 4,061,104 which teaches a watercraft with pairs of rotary members having foil shaped peripheral portions extending into the water at an acute angle with respect to the water surface and are movable both axially and angularly to achieve optimum lift consistent with the vessel's speed.

The inventor of the present invention has also been active in this area previously in the form of U.S. Pat. No. 5,638,766. This patent disclosed a water craft comprising a hull having a main longitudinal axis defining a direction of travel of the craft, a plurality of discs mounted at respective opposed sides of the main longitudinal axis to and below the hull and in combination having sufficient buoyancy to support the hull above the water, each disc comprising an essentially circular skimming surface adapted to skim upon the water as the craft moves at speed, each disc being adapted to rotate about a rotational axis which projects laterally at an acute angle with respect to a horizontal reference plane such that the skimming surface faces downwardly and outwardly with respect to the longitudinal central axis of the hull; wherein the discs are pivotably mounted to the hull by way of a ball joint, the ball joint comprising a ball affixed to or integrally formed with a leg extending from the hull, the ball extending into a socket formed within the disc and being retained therein by a retention flange secured to the disc.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a watercraft, which may at least partially overcome at least one of the abovementioned disadvantages or provide the consumer with a useful or commercial choice.

With the foregoing in view, the present invention in one form, resides broadly in a water craft including a hull having a main longitudinal axis defining a direction of travel of the craft, a plurality of discs mounted at respective opposed sides of the main longitudinal axis to and below the hull and in combination having sufficient buoyancy to support the hull above the water, each disc comprising an essentially circular skimming surface adapted to skim upon the water as the craft moves at low speed, wherein the discs are mounted to the hull such that the skimming surface of each disc faces downwardly with respect to the longitudinal central axis of the hull, and adapted for movement between a low speed orientation in which the discs present a portion of the circular convex skimming surface to the water surface and a high speed orientation in which the discs present a portion of the edge of the disc to the water.

Typically, the main craft body or hull is supported above and out of the water as a result of buoyancy of the discs, particularly when the craft is in motion. The discs may be considered the main or only buoyancy for the water craft. That is, the total buoyancy of the craft is dependent upon the configuration, size and/or number of discs attached.

The discs may have any shape and the actual shape of the discs may be hydrodynamically optimised to present the best shape at low speed and high speeds. For example, the discs will normally have a convex upper surface but the lower surface of the disc may be flattened, partially or totally concave, convex or a "special" shape which has aspects of any combination of other shapes for example, a wave shaped lower surface.

As the discs are for use in a liquid environment, it is necessary to lay them down such that when the vessel is at low speed or is stationary, the maximum of surface area is in contact with the water, thus gaining the maximum of buoyant effect.

At low speeds, the discs will typically be oriented substantially horizontally. As the craft will typically be powered from a rear mounted position and the application of power to move the craft will typically force the rear of the craft downwardly and raise the bow of the craft. This effect, in combination with the forward motion of the craft when under power, will preferably result in the flow past each disc self-aligning to a portion of the disc upon which the craft is supported. Each disc will typically find its own optimised "sweet spot" at any given speed.

At least some of the discs will typically have an associated suspension system to absorb at least some of the shock of wavelets for example as the craft passes, particularly if the craft is operated in at a higher speed with the discs relatively flat.

It might be necessary, dependent upon the size and configuration of the craft and discs to limit the angle through which the discs may pivot. At no time should the leading edge of the discs drop below the horizontal as this would allow the disc to penetrate or dive below the surface, thus capsizing the craft. To this end, pivot limitation devices may be adapted to cooperate with each disc.

The means for connecting the disc to the watercraft, particularly to allow the control of the orientation of the discs will typically of one dimpled, spherical, non-rotating fixture and one matching smooth surfaced cup located within the disc. The dimples might act to reduce the surface area and friction whilst capturing water and air within the assembly which acts as a lubricant and negates the need for mechanical metal adaptations.

The discs are normally configured in pairs mounted on opposed sides of the craft. The pairs of discs are normally oriented and moved as a pair with both discs in the pair normally oriented at the same angle, although this is not necessarily always the case. For example, to trim the craft when in high speed mode, pairs of discs at the front of the craft may be oriented to present more of their edges to the water whereas pairs of discs located toward the rear of the craft may present more of the circular convex skimming surface towards the water surface.

The portion of the circular convex skimming surface which is presented to the water surface will typically be the inside rear quadrant. Different discs or pairs of discs may be oriented for minimal surface area whilst others may be oriented to support the craft.

The discs are preferably adjustable. Normally a portion of the disc upper surface is mounted to an arm extending to the hull of the craft. Typically the attachment may be associated with a ball joint or similar in order to adjust the orientation of the disc.

The attachment mechanism between the arm and the disc will include a number of adjustable means which may be mounted internally of the disc or externally.

For example, the arm may be mounted on an arcuate track oriented from inboard of the craft to outboard or substantially perpendicular to the direction of travel of the craft. The track can then be mounted to a second arcuate track oriented parallel to the direction of travel of the craft. The second track may be rotatably mounted about a substantially vertical axis which is perpendicular to the first and second tracks. In this manner, the orientation of the disc will be adjustable in three directions.

In a particularly preferred embodiment, the discs will be attached to the bottom shell of the craft. The shape of the bottom shell will typically be adapted to mount the discs when the discs are in both the low speed and the high speed configurations. In particular, when the discs are in the high speed configuration, that is when the discs are rotated laterally to present an edge portion to the water, the bottom shell will be required to allow this movement.

The bottom shell will therefore typically include enlarged strakes relative to which the discs are mounted. The strakes are preferably aligned substantially parallel to the direction of travel. The strakes will normally be deeply angled, extending downwardly from the bottom of the craft. The strakes will normally have a pair of lateral surfaces which converge as the strake extends away from the bottom of the craft. The lateral surfaces may be arcuate and are preferably concave and converge to a strake tip. The lateral sides of two adjacent strakes will preferably create concave flow tunnels under the craft which in turn may create lift when the craft is moving.

The strakes will also preferably taper downwardly from the front of the craft towards the rear with the rear of the strake extending further downwardly than the forward portion of the strake.

The strakes will preferably extend downwardly sufficiently to allow the discs to rotate laterally about the lower extremity of the strake when moving between the low speed and the high speed configuration. The discs are preferably mounted relative to the strake tip. There will typically be a plurality of strakes spaced across the bottom of the craft and the spacing is typically such that the discs can be rotated between the strakes without blocking the adjacent discs or the discs of adjacent strakes.

The provision of the strakes also preferably results in the air flow being directed towards the rear of the craft, particularly at higher speeds. Due to the location and shape of the strakes, the airflow is prevented from escaping laterally from under the vessel and is directed rearwardly.

The strakes are typically provided with a pair of central or main longitudinal strakes and pairs of lateral strakes also oriented longitudinally and spaced toward each side of the craft. The main strakes will normally be larger for larger vessels and may be absent for smaller vessels with only a pair of outer strakes provided.

The efficiency of the strakes of the preferred embodiment will preferably increase as the strakes are wetted. Whilst not wishing to be limited by theory, as the strakes are wet, the layer of water formed will typically decrease drag through the boundary layer effects.

Normally the discs are provided (and moved) in a line relative to a strake in order to minimise drag. Typically the front edge of the forward-most disc will spread the water as it passes and the following discs can move through the disturbed water.

The discs provided will normally be provided clustered about the craft's centre of buoyancy.

The discs may be free spinning or be rotatably driven. Driving the discs may be accomplished by providing each disc with a mounting member which is substantially circular. The upper portion of the disc may have an opening into which the mounting member may be received. The connection between the mounting member and the surrounds of the opening can define whether the disc is free spinning or driven or interchangeable between the two modes. For example, a friction drive may drive the discs if required.

If driven, preferably the speed of rotation of the discs is such that the angular velocity of the disc is approximately equal to the velocity at which the water passes the craft in order to minimise friction.

Preferably the discs are moveable from a substantially horizontal orientation when the craft is at rest and at low speed to a more upright, possibly substantially vertical orientation when the craft is at higher speed. The degree of loft of the discs is preferably adjusted relative to the speed of the craft.

When at higher speeds, as well as being oriented more edgewise, the front pairs of discs may be oriented inwardly at their forward edge with the disc pairs oriented progressively less inwardly and more horizontally to create a virtual V-shaped hull through a combination of the surfaces of the discs at the high speeds. This configuration may increase the buoyancy of the craft by creating hydrodynamic lift.

The rear discs may be in-line, that is oriented more directly behind the disc directly in front.

For larger craft, additional discs or disc pairs may be located at the rear or stern of the craft may be provided for load or weight distribution with fewer discs located toward the forward or bow end of the craft.

Hull shape is also particularly important when the craft is moving at high speed.

According to a second form, the present invention resides in a water craft including: a hull having a main longitudinal axis defining a direction of travel of the craft, a plurality of discs mounted at respective opposed sides of the main longitudinal axis to and below the hull and in combination having sufficient buoyancy to support the hull above the water, each disc comprising an essentially circular convex skimming surface adapted to skim upon the water as the craft moves at low speed, wherein the discs are mounted to the hull such that the skimming surface of each disc faces downwardly and outwardly with respect to the longitudinal central axis of the hull, the hull having a wave piercing configuration with a sharply tapered forward edge and at least one tapered vee section.

The term "hull" when used in a maritime sense, generally means the body or frame of a ship or boat. It is a central concept in water vessels. The hull is essentially what keeps the water from entering the boat and acts as the walls and floor of the vessel. In the context of the present invention, the term "hull" is essentially the same except that the hull of the watercraft of the present invention will typically be maintained above the water surface at all times.

The hull will typically have a sharp or pointed nose or bow portion and diverge or widen behind the nose portion. The hull may preferably be shaped to have a tapered nose and backbone edge (or "stem") and widen as the craft extends rearwardly and downwardly. This configuration may be referred to as a "fine entry angle" or having "a high amount of deadrise". This shape of hull will preferably increase the craft's ability not only to pierce any waves but also to shed any water which may strike the hull, thereby decreasing the weight of the craft.

The hull will preferably have the largest decks located lower down or more towards the waterline which is opposite to conventional watercraft which necessarily have their larger decks uppermost to a diverging hull shape as opposed to the converging hull shape preferred for the present invention. This also contributes to the stability of the craft of the present invention.

The efficiency of the hull of the preferred embodiment will preferably increase as the body is wetted. Whilst not wishing to be limited by theory, as the body of the craft is wet, the layer of water formed will typically decrease drag through the boundary layer effects.

The contour of the underside of the craft may be designed to provide a positive pressure below the craft at speed. The underbody shape will also typically act to stabilise the craft at higher speeds. The body of the craft is also adapted to be closeable, that is to have a minimum (or no) open deck space when the craft is moving. Preferably, the craft will have deployable deck portions which can be opened when required.

This configuration will typically allow the hull to pierce water rather than spreading the water as it passes which increases friction and therefore slows the craft.

The arms or other members mounting the discs and attaching the discs relative to the hull will also be tapered to present a sharp edge forwardly and widen towards the rear of the craft.

The water craft may be driven using any form of propulsion or power source. Propulsion for craft may be provided by an outboard motor mounted at the stem, or by jet propulsion or any other suitable means. For example, the craft may be a sail craft.

The lower surface of the hull will typically be spaced from the lower ends of the arms or other members mounting the discs (and thereby the water surface) particularly at higher speeds, and normally by at least a dimension equal to the radius of the discs.

A keel may be provided to prevent or minimise flight at higher speeds. The keel may also prevent or control side drift or "slewing" at higher speeds. The keel may be a simple planar keel with a sharper front edge or it may have a more complex shape for example a winged keel with a vertical member and at least one and typically a pair of wing portions extending at an angle from a lower portion of the vertical member.

There may be more than one keel. The keel will typically be oriented to be parallel to the direction of travel of the craft.

It is the intent of the hull shape of the present invention to minimise the shape of the forward surface of the craft in order to increase its speed. The keel of the invention may be deployable at a predetermined speed and may be stored at lower speed to minimise the drag created.

One or more of the discs may be separately rotatably driven. In a preferred embodiment, a number of radially extending fins may be provided on the underside of each disc. That is, the discs may form a means of propulsion of craft, should a separate hull mounted power unit not be provided. Electric motors may be provided in each disc, or alternatively, torque may be transmitted to the discs from shafts which extend to a power unit within hull.

The craft will normally be powered from an upper portion of the rear of the craft. A vectored jet may be preferred.

According to a further aspect, the present invention resides in a water craft including a hull having a main longitudinal axis defining a direction of travel of the craft, a plurality of discs mounted at respective opposed sides of the main longitudinal axis to and below the hull and in combination having sufficient buoyancy to support the hull above the water, each disc comprising an essentially circular convex skimming surface adapted to skim upon the water as the craft moves at low speed, wherein the discs are mounted to the hull such that the skimming surface of each disc faces downwardly with respect to the longitudinal central axis of the hull, at least some of the discs adapted for movement between a low speed orientation in which the discs present a portion of the circular convex skimming surface to the water surface and a high speed orientation in which at least some of the rearward discs present a portion of the circular convex skimming surface to the water surface and at least some of the forward discs present a portion of the edge of the disc to the water.

BRIEF DESCRIPTION OF THE DRAWINGS

Various embodiments of the invention will be described with reference to the following drawings, in which:

FIG. 9 includes various views of a watercraft according to still a further aspect of the present invention.

DETAILED DESCRIPTION OF THE PREFERRED EMBODIMENT

According to the illustrated embodiment, a water craft 10 is provided.

Each of the various configurations of water craft 10 illustrated in FIGS. 5 to 14 includes a hull 11 having a main longitudinal axis defining a direction of travel of the craft 10, a plurality of discs 12 mounted at respective opposed sides of the main longitudinal axis to and below the hull 11 and in combination having sufficient buoyancy to support the hull 11 above the water, each disc 12 comprising an essentially circular convex skimming surface D adapted to skim upon the water as the craft 10 moves at low speed, wherein the discs 12 are mounted to the hull 11 such that the skimming surface D of each disc 12 faces downwardly and outwardly with respect to the longitudinal central axis of the hull 11, at least some of the discs 12 having an associated suspension system and adapted for movement between a low speed orientation in which the discs 12 present a portion of the circular convex skimming surface D to the water surface and a high speed orientation in which the discs 12 present a portion of the edge of the disc 12 to the water.

Figure 1:
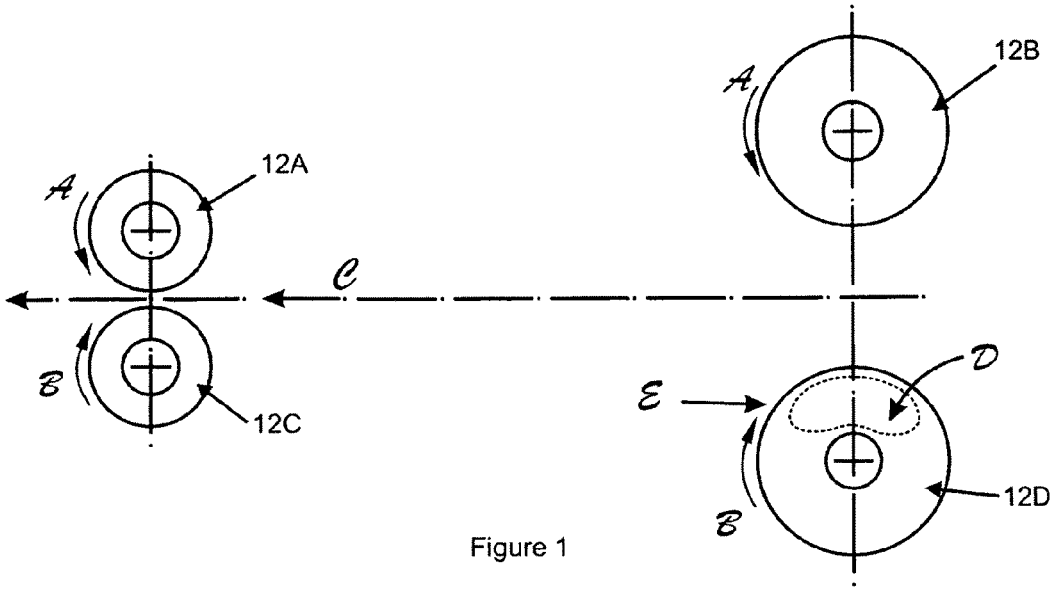
FIG. 1 is a schematic top view of the preferred arrangement of discs for a craft having four discs.
Figure 2A:
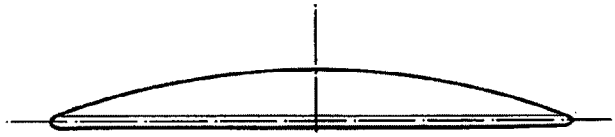
FIG. 2A to 2D are schematic side views of a variety of shapes of discs which may be used according to the invention.
Figure 2B:
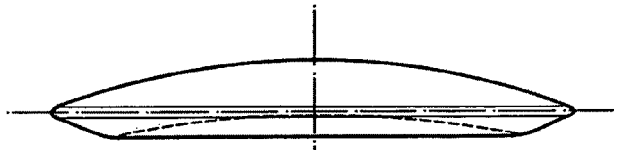
Figure 2C:
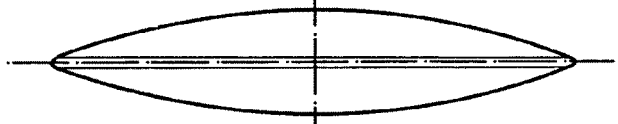
Figure 2D:
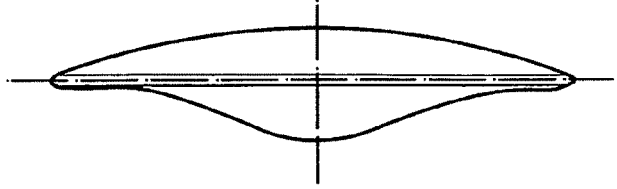

With reference to FIG. 1, as craft 10 moves in a forward direction indicated by arrow C, discs 12A and 12B, which are free spinning, rotate in an anti-clockwise direction as indicated by arrows A. Similarly, discs 12C and 12D, which are free spinning, will rotate in a clockwise direction as indicated by arrows B.

The discs 12 of the illustrated embodiment rotate as a result of the flow of water therepast. In the case of disc 12D, and as shown in FIG. 1, zone D of the underside of the disc is acted upon by water flowing in the direction indicated by arrow E. It is that flow that causes rotation of disc 12D in the direction indicated by arrow B.

As illustrated in FIGS. 5 to 14, the main craft body or hull 11 is supported above and out of the water as a result of buoyancy of the discs 12, particularly when the craft is in motion. The discs 12 are the only buoyancy for the water craft 10. That is, the total buoyancy of the craft is dependent upon the configuration, size and/or number of discs attached.

Figure 7:
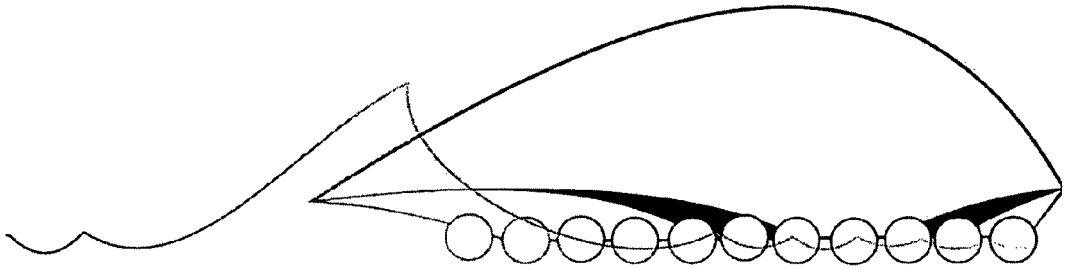
FIG. 7 is a schematic side view of a watercraft according to an aspect of the present invention showing a "rogue" wave.
Figure 8:
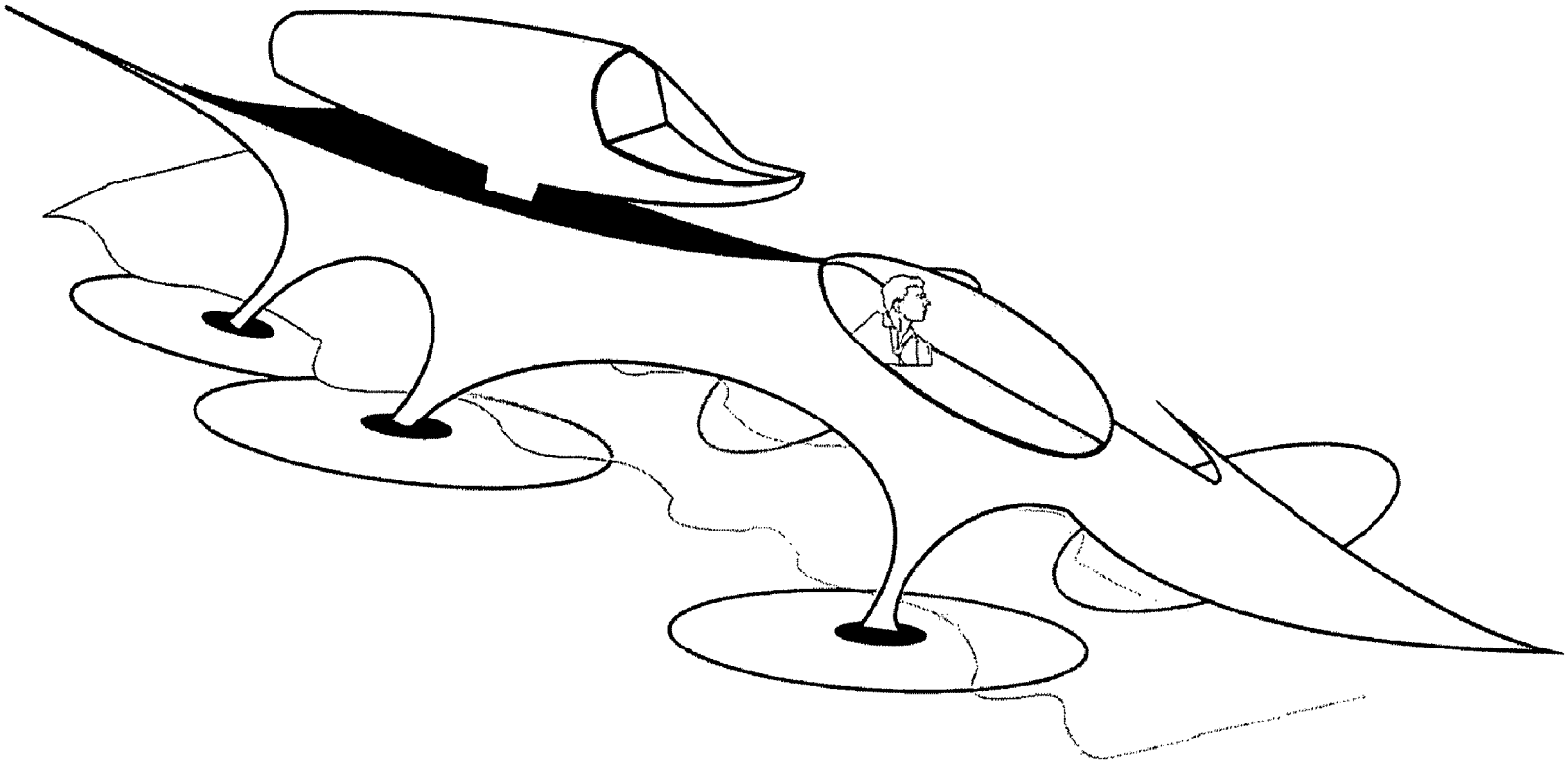
FIG. 8 is a perspective view of a watercraft according to a further aspect of the present invention.
Figure 10:
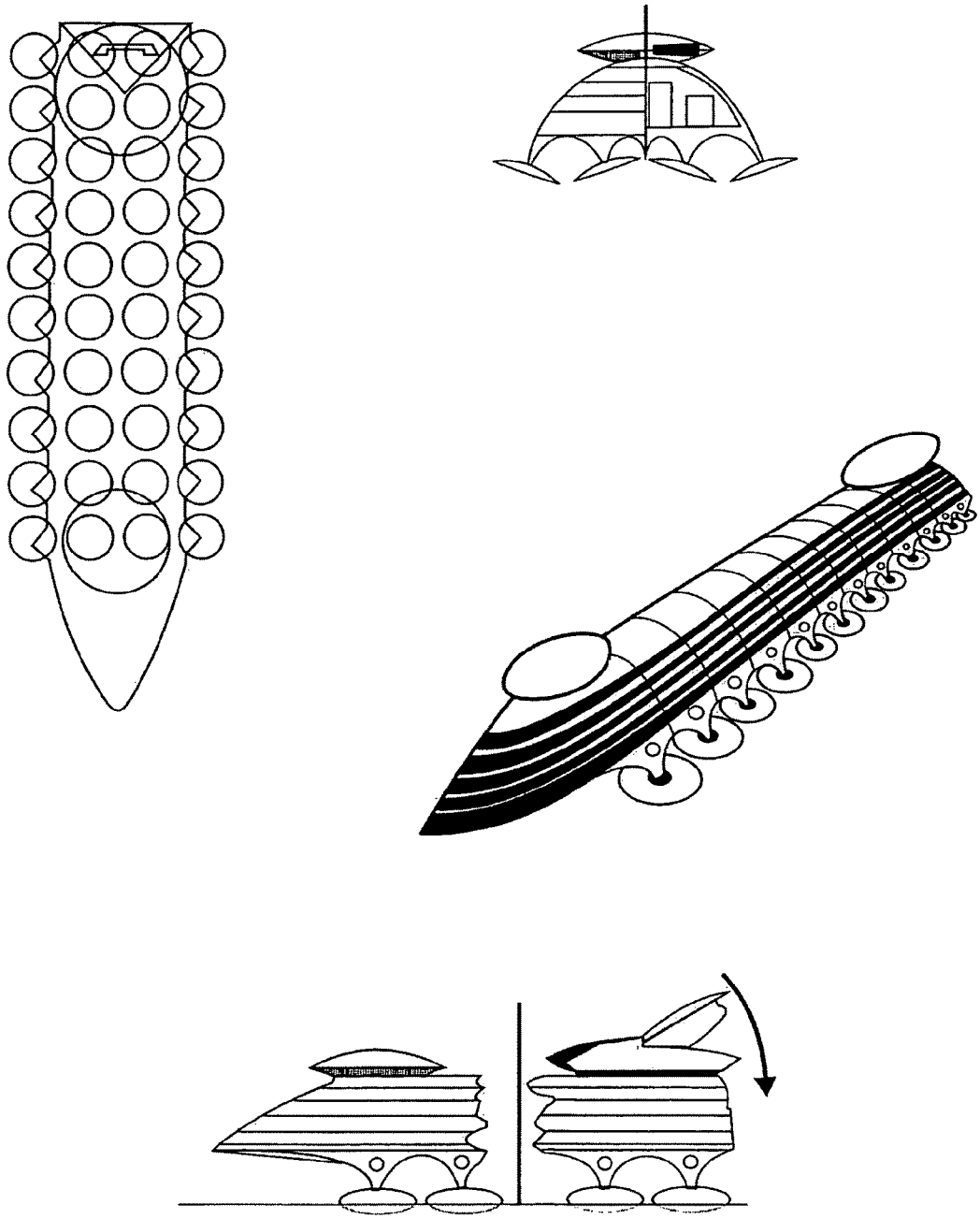
FIG. 10 includes various views of a watercraft according to yet a further aspect of the present invention.
Figure 11:
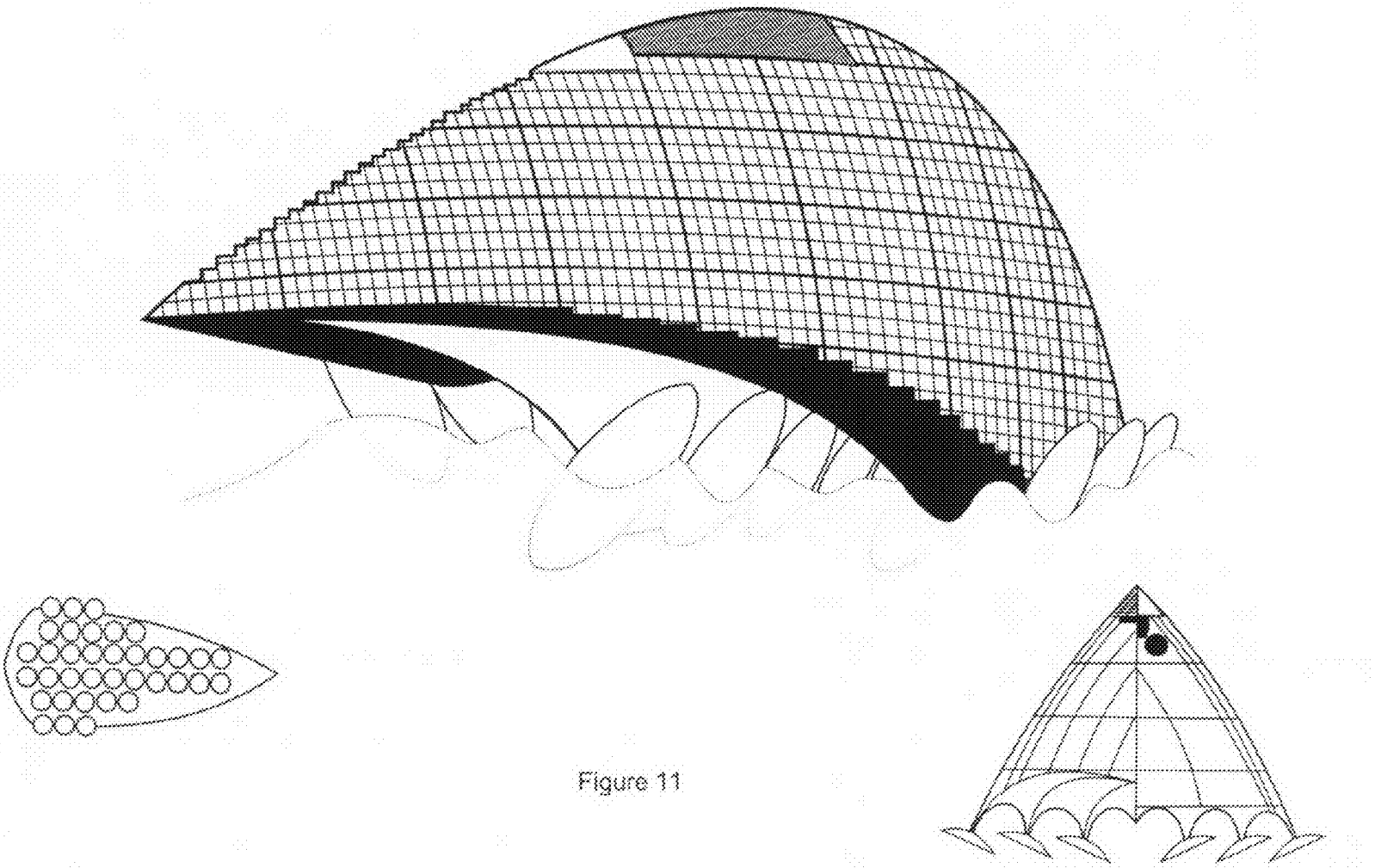
FIG. 11 includes various views of a watercraft according to still a further aspect of the present invention.

At low speeds, all of the discs 12 are oriented with a portion of the circular convex skimming surface (portion D in FIG. 1) to the water surface such that when stationary and at low speeds, the maximum of surface area is in contact with the water, thus gaining the maximum buoyant effect. A water craft having discs configured in this manner is illustrated in FIG. 7 in particular.

According to this stationary or low speed configuration, the angles of the discs 12 relative to the water surface are predisposed in such a way as to place the inside, rear quadrant of the bottom disc surface at the lowest point although the discs will normally self-align to find their own sweet spot. This area is considered to be the maximum area of grip upon the disc which reduces the speeds attainable with the discs configured in this manner.

As illustrated in the Figures, the discs 12 are normally configured in pairs mounted on opposed sides of the craft 10. The pairs of discs are oriented and moved as a pair, with both discs 12 in the pair normally oriented at the same angle.

According to a particularly preferred configuration, to trim the craft when in high speed mode, pairs of discs at the front of the craft may be oriented to present more of their edges to the water whereas pairs of discs located toward the rear of the craft may preset more of the circular convex skimming surface towards the water surface.

In the illustrated embodiments, the discs attached to the bottom shell of the craft. The bottom shell includes enlarged strakes relative to which the discs are mounted. The strakes are aligned substantially parallel to the direction of travel. The strakes are deeply angled, extending downwardly from the bottom of the craft and have a pair of lateral concave surfaces which converge to a strake tip, as the strake extends away from the bottom of the craft. The lateral sides of two adjacent strakes create concave flow tunnels under the craft which in turn may create lift when the craft is moving.

Figure 3:
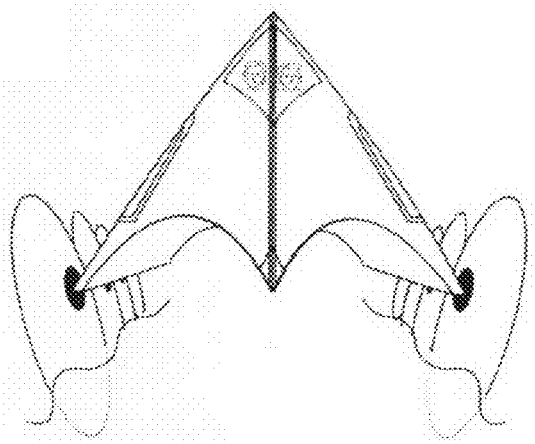
FIG. 3 is a view from the front of a watercraft according to an aspect of the present invention in the high speed configuration.
Figure 4:
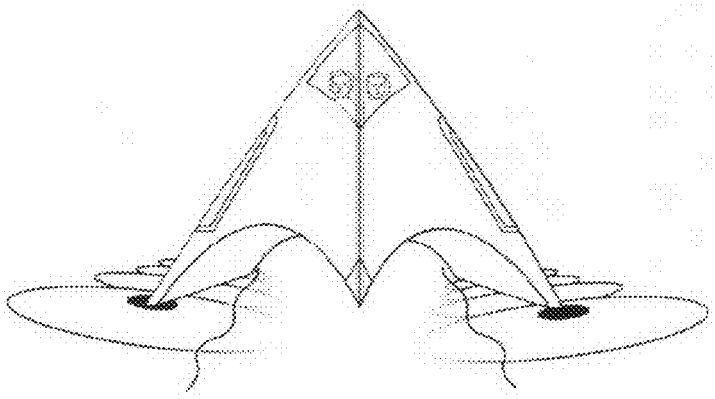
FIG. 4 is a view from the front of the watercraft illustrated in FIG. 5 in the low speed or stopped configuration.
Figure 5:
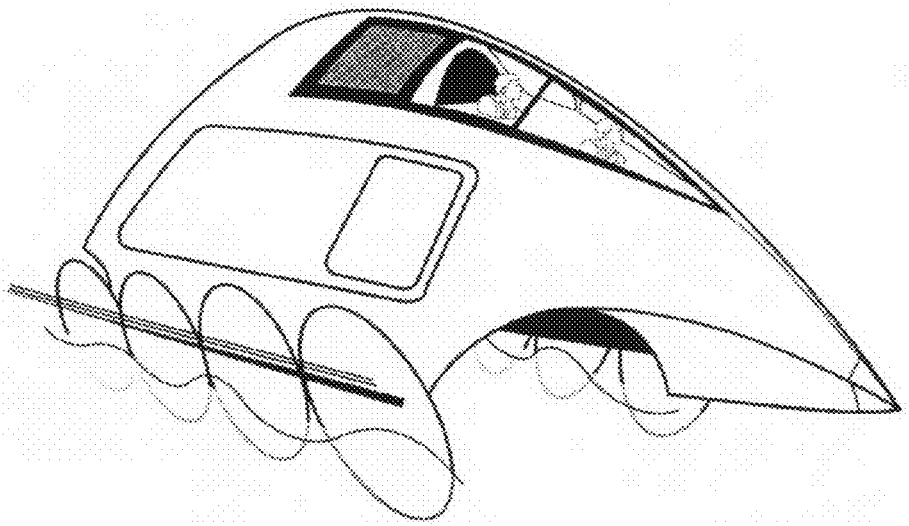
FIG. 5 is a schematic view of a watercraft according to a second aspect of the present invention.
Figure 6:
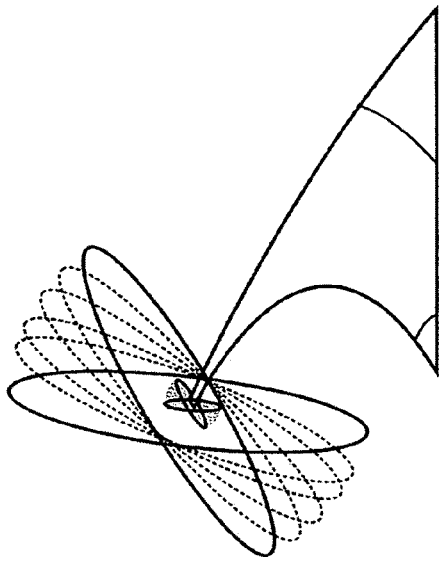
FIG. 6 is a schematic view of an arm and disc configuration illustrating the range of motion for the disc according to a preferred embodiment.

The strakes extend downwardly sufficiently to allow the discs to rotate laterally about the lower extremity of the strake when moving between the low speed and the high speed configuration as illustrated in FIGS. 2 and 3. The discs are mounted relative to the strake tip.

Figure 12:
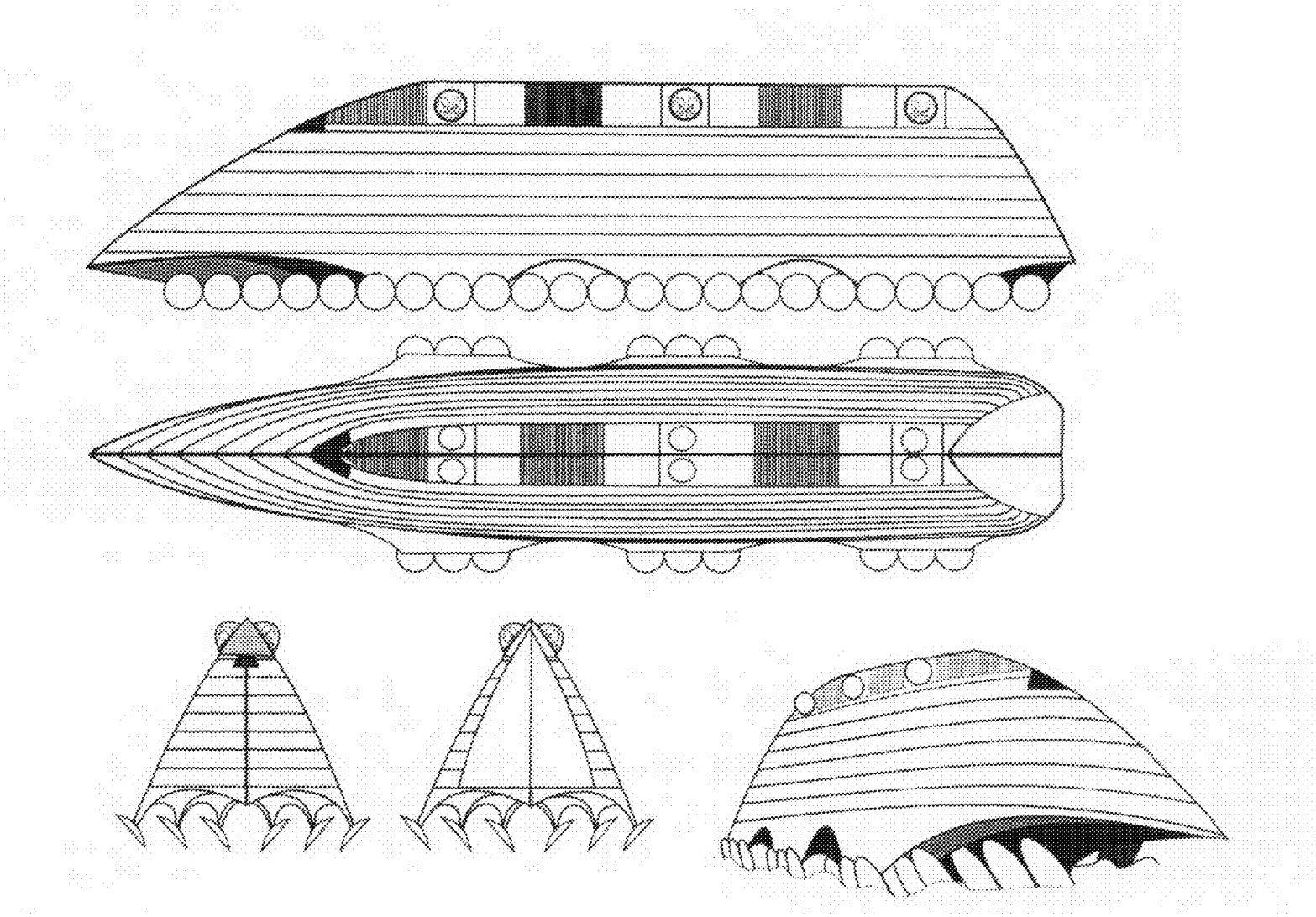
FIG. 12 includes various views of a watercraft according to yet a further aspect of the present invention.
Figure 13:
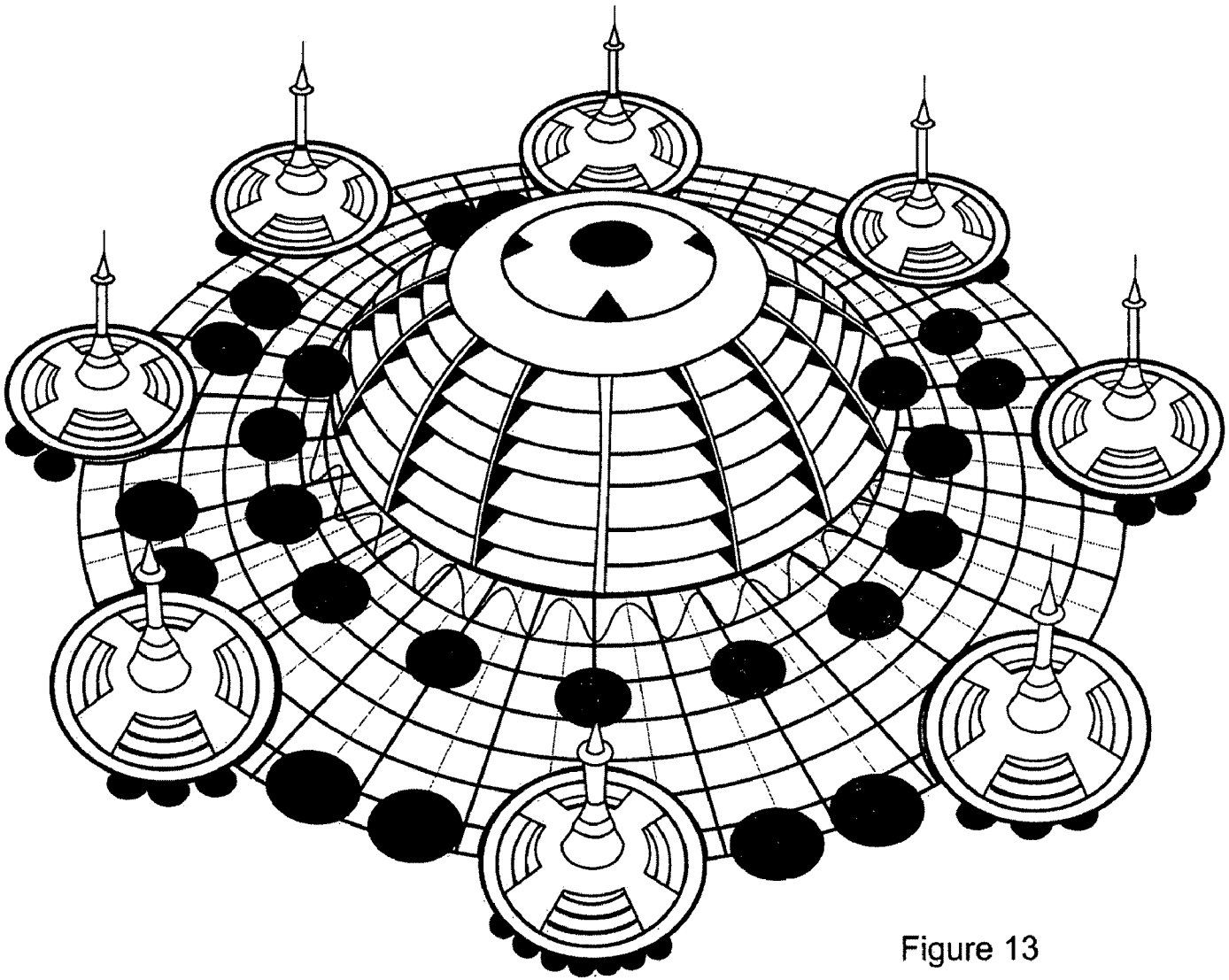
FIG. 13 is a perspective view of a watercraft according to a "floating hotel" aspect of the present invention.
Figure 14:
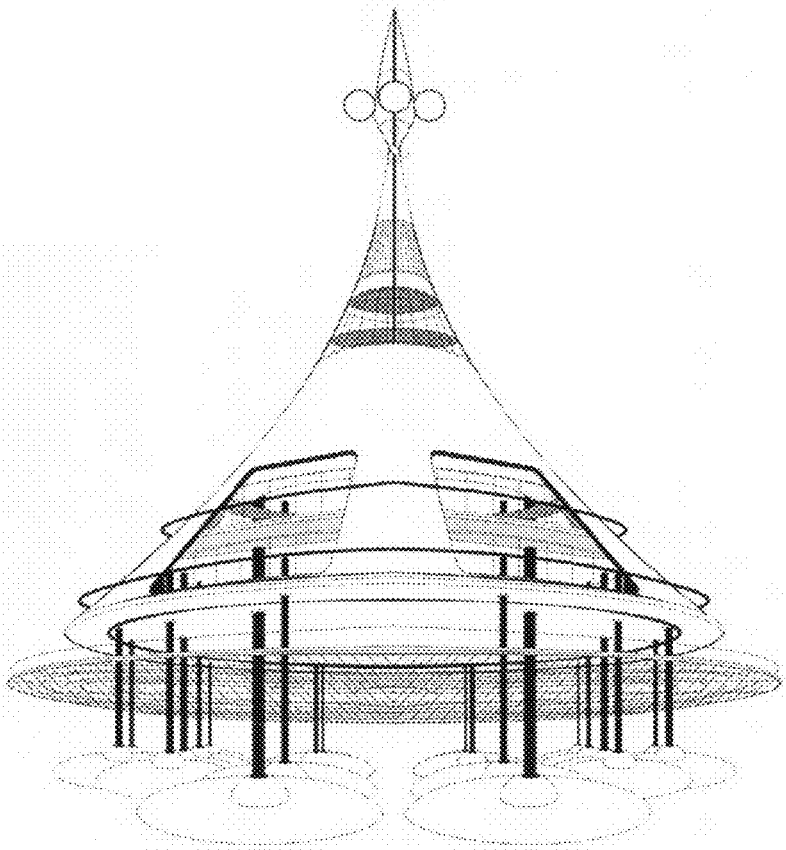
FIG. 14 is a partial illustration of a floating dwelling embodiment of the present invention.
Figure 15:
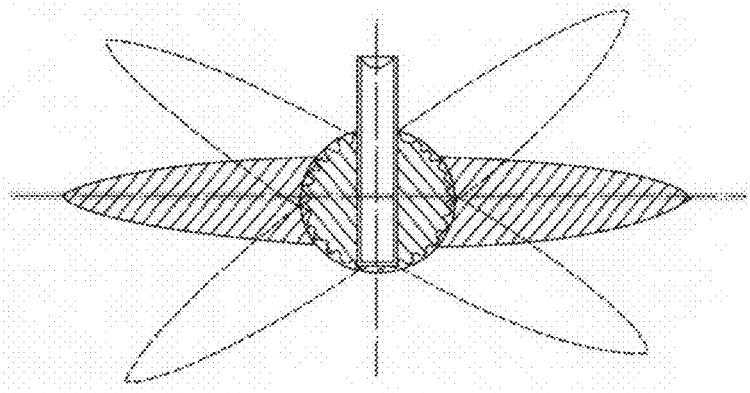
FIG. 15 is a detailed sectional illustration of a disc showing the range of movement of a disc available according to the embodiment illustrated in FIG. 14 in the two main lateral directions.
Figure 16:
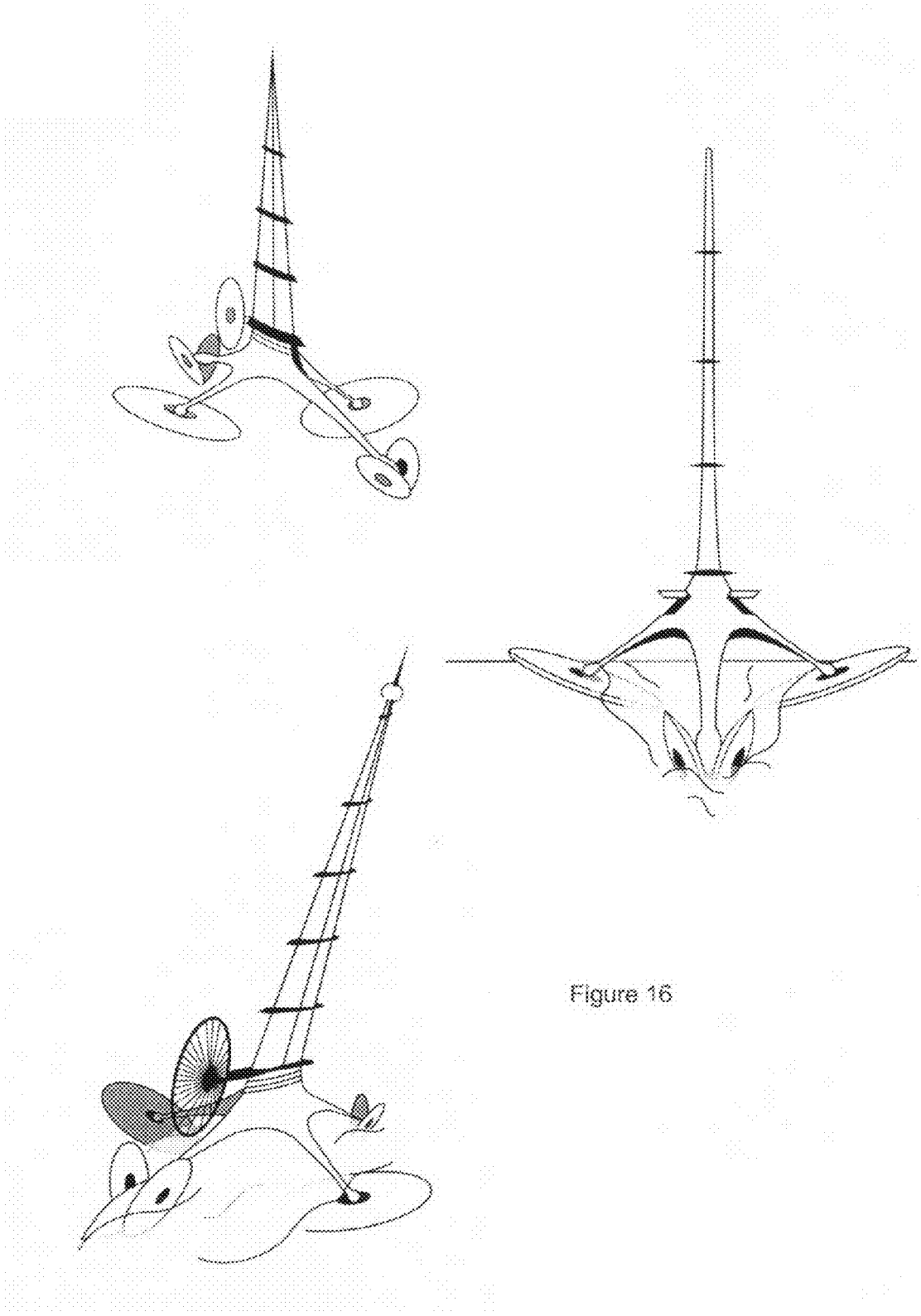
FIG. 16 includes various views of a watercraft according to a first aspect of the present invention, in a "sail" powered configuration.
Figure 17A:
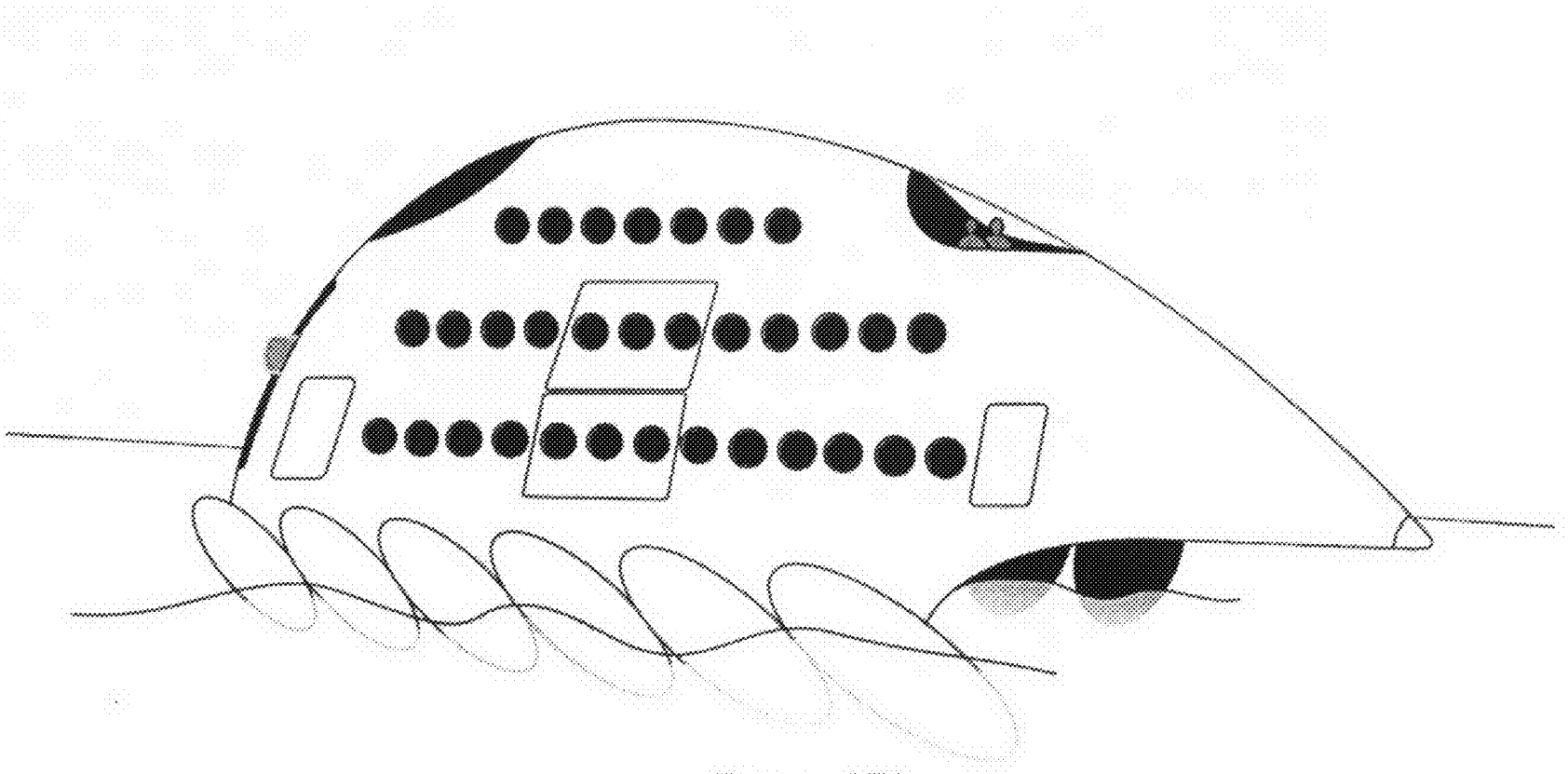
FIG. 17A is a schematic illustration of a watercraft according to a developed embodiment.
Figure 17B:
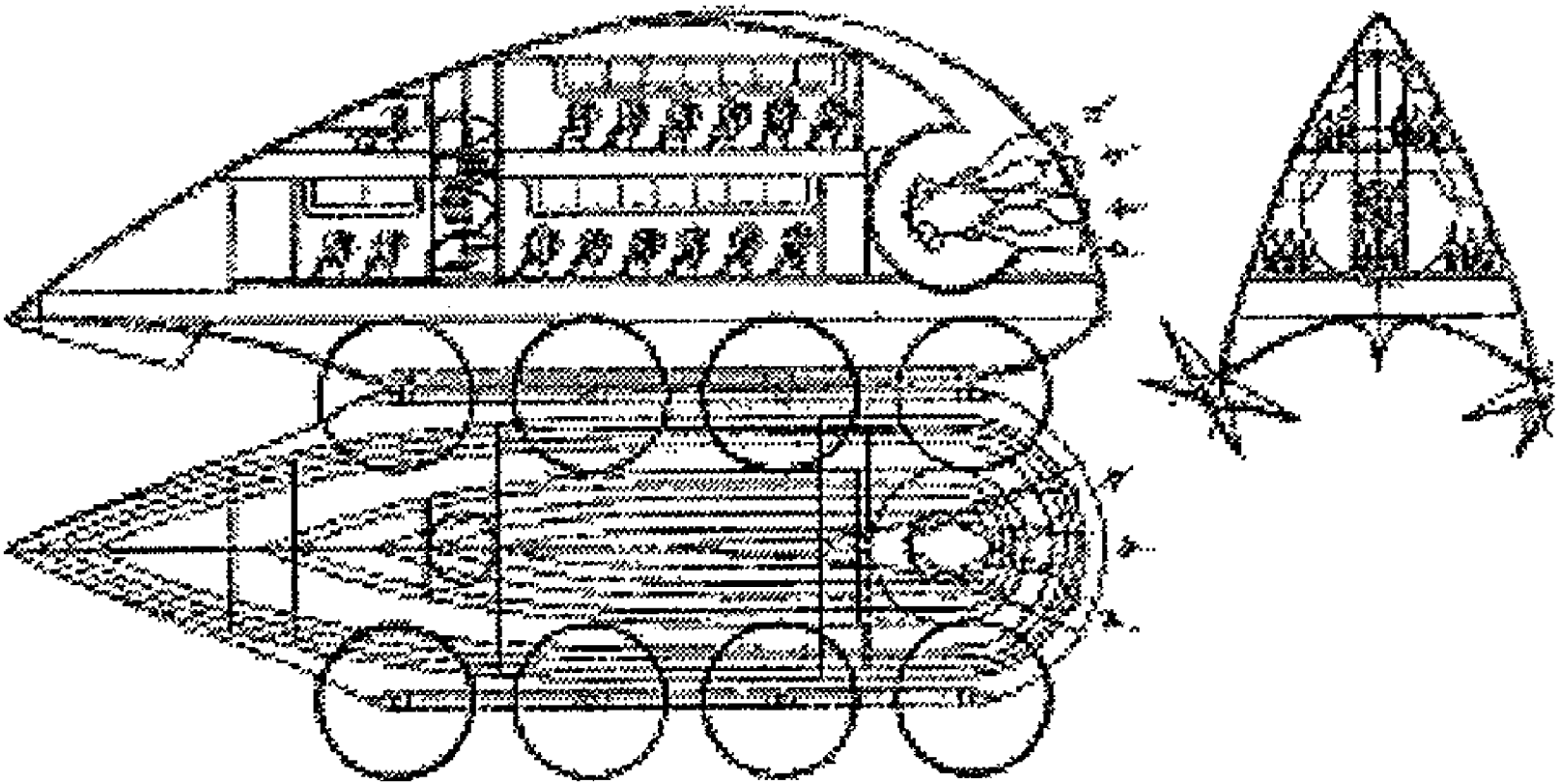
FIG. 17B includes sectional side and end views and a view from beneath the watercraft illustrated in FIG. 17A.

As illustrated in FIGS. 12 and 13 in particular, there are a plurality of strakes spaced across the bottom of the craft and the spacing is such that the discs can be rotated between the strakes without blocking the adjacent discs on the same strake or the discs of adjacent strakes.

Normally the discs are provided (and moved) in a line relative to a strake in order to minimise drag. Typically the front edge of the forward-most disc will spread the water as it passes and the following discs can move through the disturbed water.

The discs provided will normally be provided clustered about the crafts centre of buoyancy as illustrated in FIG. 12 in particular.

If the discs are rotatably driven, the speed of rotation of the discs is such that the angular velocity of the disc is approximately equal to the velocity at which the water passes the craft in order to minimise friction.

The discs are moveable from a substantially horizontal orientation when the craft is at rest and at low speed to a more upright, substantially vertical orientation when the craft is at higher speed, such as that illustrated in FIGS. 6, 10, 12 and 13. The degree of loft of the discs is adjusted relative to the speed of the craft.

The rear discs are typically in-line, that is oriented more directly behind the disc directly in front as illustrated in FIGS. 6, 10, 12 and 13.

For larger craft, additional discs or disc pairs may be located at the rear of the craft may be provided for load or weight distribution with fewer discs located toward the forward end of the craft such as is illustrated in FIG. 12.

Hull shape is also particularly important when the craft is moving at high speed. The hull of the craft of the illustrated embodiments each have a wave piercing configuration with a sharply tapered forward edge and at least one tapered vee section.

The hull of the illustrated embodiments have a sharp or pointed nose or bow portion and diverge or widen behind the nose portion. The hull may preferably be shaped to have a tapered nose and backbone edge and widen as the craft extends rearwardly and downwardly.

This configuration will typically allow the hull to pierce water rather than spreading the water as it passes which increases friction and therefore slows the craft. This shape of hull will also increase the craft's ability to shed any water which may strike the hull, thereby decreasing the weight of the craft.

The strakes mounting the discs 12 and attaching the discs relative to the hull will also be tapered to present a sharp edge forwardly and widen towards the rear of the craft.

As illustrated in the Figures, the lower surface of the hull is spaced from the lower ends of the strakes mounting the discs (and thereby the water surface) particularly at higher speeds, and normally by at least a dimension equal to the radius of the discs.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. A water craft including a hull having a main longitudinal axis defining a direction of travel of the craft, a plurality of discs mounted at respective opposed sides of the main longitudinal axis to and below the hull and in combination having sufficient buoyancy to support the hull above water, each disc comprising an essentially circular convex skimming surface adapted to skim upon the water as the craft moves at low speed, wherein the discs are mounted to the hull such that the skimming surface of each disc faces downwardly with respect to the longitudinal central axis of the hull, and adapted for movement between a low speed orientation in which the discs present a portion of the circular convex skimming surface to the water surface and a high speed orientation in which the discs present a portion of the edge of the disc to the water, and wherein the hull has a bottom shell including enlarged strakes relative to which the discs are mounted, wherein the strakes are aligned substantially parallel to the direction of travel, wherein each strake has a pair of arcuate and concave lateral surfaces which converge to a strake tip as the strake extends away from the bottom of the craft, and wherein the lateral sides of adjacent strakes define concave flow tunnels under the craft which in turn create lift when the craft is moving.

2. A water craft as claimed in claim 1 wherein the hull has a wave piercing configuration with a sharply tapered forward edge and at least one tapered vee section.

3. A water craft as claimed in claim 2 wherein the hull has a tapered nose or bow and backbone edge or stem, the craft widening as it extends rearwardly and downwardly.

4. A water craft as claimed in claim 2 wherein the hull above the waterline is adapted to be closeable, that is to have a minimum open deck space when the craft is moving.

5. A water craft according to claim 1 wherein a lower surface of the hull is spaced from the water surface.

6. A water craft as claimed in claim 1 wherein the hull is supported above and out of the water as a result of buoyancy of the discs when at low speed or at rest.

7. A water craft as claimed in claim 1 wherein at low speed, the flow past each disc self-aligns the position of the disc to a portion of the disc upon which the craft is supported.

8. A water craft according to claim 1 wherein at least some of the discs have an associated suspension system to absorb at least some of the shock of wavelets when the craft is operated in at a higher speed with the discs in the low speed orientation.

9. A water craft according to claim 1 wherein a limiter is provided to limit an angle through which each disc pivots to prevent a leading edge of each disc dropping below a substantially horizontal plane.

10. A water craft according to claim 1 wherein discs are configured in pairs mounted on opposed sides of the craft.

11. A water craft as claimed in claim 10 wherein each pair of discs is oriented and moved as a pair with both discs in the pair oriented at the same angle.

12. A water craft including a hull having a main longitudinal axis defining a direction of travel of the craft, a plurality of discs mounted at respective opposed sides of the main longitudinal axis to and below the hull and in combination having sufficient buoyancy to support the hull above water, each disc comprising an essentially circular convex skimming surface adapted to skim upon the water as the craft moves at low speed, wherein the discs are mounted to the hull such that the skimming surface of each disc faces downwardly with respect to the longitudinal central axis of the hull, and adapted for movement between a low speed orientation in which the discs present a portion of the circular convex skimming surface to the water surface and a high speed orientation in which the discs present a portion of the edge of the disc to the water, and wherein the craft is powered from an upper portion of the rear of the craft using a vectored propulsion means.

13. A water craft including a hull having a main longitudinal axis defining a direction of travel of the craft, a plurality of discs mounted at respective opposed sides of the main longitudinal axis to and below the hull and in combination having sufficient buoyancy to support the hull above water, each disc comprising an essentially circular convex skimming surface adapted to skim upon the water as the craft moves at low speed, wherein the discs are mounted to the hull such that the skimming surface of each disc faces downwardly with respect to the longitudinal central axis of the hull, and adapted for movement between a low speed orientation in which the discs present a portion of the circular convex skimming surface to the water surface and a high speed orientation in which the discs present a portion of the edge of the disc to the water, and wherein the hull has a bottom shell including enlarged strakes relative to which the discs are mounted, wherein at least one strake tapers downwardly from the front of the craft towards the rear, with a rear portion of the strake extending further downwardly than a forward portion of the strake.

* * * * *